United States Patent [19]

Toomey, Jr.

[11] Patent Number: 4,695,352

[45] **Date of Patent: * Sep. 22, 1987**

[54] ELECTROCHEMICAL REDUCTION OF PYRIDINE CARBOXAMIDE BASES

[75] Inventor: Joseph E. Toomey, Jr., Indianapolis, Ind.

[73] Assignee: Reilly Tar & Chemical Corporation, Indianapolis, Ind.

[ * ] Notice: The portion of the term of this patent subsequent to Nov. 13, 2001 has been disclaimed.

[21] Appl. No.: 688,061

[22] Filed: Dec. 31, 1984

[51] Int. Cl.[4] ..... C25B 3/00

[52] U.S. Cl. ..... 204/74

[58] Field of Search ..... 204/73 R, 74

[56] References Cited

U.S. PATENT DOCUMENTS 742,797 10/1903 Moest ..... 204/74
2,615,896 10/1952 Chase et al. ..... 546/344
4,482,437 11/1984 Toomey ..... 204/59 R

OTHER PUBLICATIONS

*Organic Electrochemistry*, Baizer and Lund Editors, Dekkar, New York, 1983, p. 385.
James P. Coleman, "The Electrochemistry of Carboxylic Acids and Derivatives: Cathodic Reductions," The Chem. of Acid Deriv., QD 305.A2S95 (1979).
Benkeser et al., *J. Org. Chem.*, 35 (1970), "A New Electrochemical Method for the Selective Reduction of Aliphatic Amides to Aldehydes or Alcohols".
Schmakel et al., *J. Electrochem. Soc.*, 121 (1974), "Nicotinamide and N'-methylnicotinamide . . . ".
Santhanam et al., Bioelectrochemistry and Bioenergetics 1, (1974), "Nicotinamide-NAD Sequence: Electrochemical and Allied Chemical Behavior".
Lund, Abhandl. Deut. Akad. Wiss. Berlin Kl. Chem., Geol., Biol. 1 (1964), p. 434.
*Chemical Abstracts*, 96 (1982) p. 537, Nonaka et al., *Electrochim. Acta*, 26(7), 887-892 (1981).
Iversen, *Acta Chemica Scandinavica*, 24 (1970), 2459-2464, "Organic Electrosyntheses"; and Fry, *Synth. Org. Electro*, (1972), QD 273.F78.
*Org. Electrochem.*, Barzer & Lund, 2nd ed. (1983), QD 273.073.
Lund, *Adv. Het. Chem.* 12 (1970), 304-308.
Rusling et al., *J. Org. Chem.*, 46 (1981) 1906-1909, "Stereospecificity in the Reductive Coupling of 4-Pyridinecarboxaldehyde".
Sekiya et al., *Chem. Pharm. Bull.*, 15(2), 238-240 (1967).
Newman et al., *JACS*, 82 (1960), "The Reduction of Amides to Amines via Nitriles by Lithium Aluminum Hydride".
Ellzey et al., *J. Org. Chem., 32 (1967), "Dehydration of Primary Amides with Sodium Borohydride"*.
Lund, *Acta Chemica Scandinavica*, 17 (1963) 2325-2340, "Electroorganic Preparations".
Fry, *Syn. Org. Electro.*, QD273.F78 (1972).
*Chem. Abstracts*, 48, 10020; Micovic et al., *J. Org. Chem.*, 18, 1190-1200 (1953).
Broadbent et al., *J. Org. Chem.*, 24 (1959), "Rhenium and its Compounds as Hydrogenation Catalysts".
Sekiya et al., *Chem. Pharm. Bull.*, 14(9), 996-1006 (1966).
Thevenot et al., J. Electroanal. Chem., 40 (1972), pp. 197-207.
Serazetdinova et al., "Effect of Ammonium Ions on the Polarographic Behavior of Nitriles and Amides of Some Pyridinecarboxylic Acids," translated from Khimiya Geterotsiklicheskikh Soedinenii, No. 3, Mar. 1973.
*The Chem. of Amides*, QD 305.A7217 (1970), pp. 795-857.

*Primary Examiner*—John F. Niebling
*Attorney, Agent, or Firm*—Woodard, Emhardt, Naughton Moriarty & McNett

[57] ABSTRACT

Electrochemical reductions of pyridine carboxamide bases performed by electrolysis in a divided flow cell utilizing an ion-exchange membrane at a high hydrogen-overvoltage cathode and in an aqueous or partly aqueous medium comprising a Lowry-Bronsted acid in at least a 1:1 equivalent ratio with the pyridine carboxamide base. A titanium salt catalyst and other means are disclosed to add selectivity to the reduction and improve yield of the amine or other desired reaction product. With all bases, significant advantages of a commercial and industrial nature are reported over prior art static, beaker cell technology.

15 Claims, No Drawings

ELECTROCHEMICAL REDUCTION OF PYRIDINE CARBOXAMIDE BASES

BACKGROUND OF THE INVENTION

This invention relates generally to the field of pyridine chemistry with particular application in providing improved electrochemical processes for the reduction of pyridine carboxamide bases in commercially practicable flow cells. In this regard, this invention constitutes an improvement and continuation of applicant's earlier work as described and claimed in his prior patent application, Ser. No. 597,013 filed Apr. 5, 1984 and entitled Electrochemical Reductions of Cyanopyridine Bases, which has since issued as U.S. Pat. No. 4,482,437 on Nov. 13, 1984.

Much attention has focused over the years on the reduction of carboxamides in general, which are organic compounds containing the radical "—$CONR^1R^2$" to their corresponding amines or alcohols. The field of pyridine chemistry has been no less attentive than others in this regard, with the products of such reduced pyridine carboxamides exhibiting valuable uses in such applications as pharmaceutical products, carbon dioxide scavengers, corrosion inhibitors, chelating agents, and others.

Historically, three approaches have been used to reduce these carboxamides to their corresponding alcohols or amines, those being catalytic hydrogenation, chemical reduction, and electrochemical reduction. In this regard, the ideal approach would be one that selectively produced high yields of alcohol or amine using an inexpensive reducing agent, low temperatures, and not involving heavy demands on, or uses of, pollution control procedures. Reported successes approaching this ideal have been few. For instance, reported catalytic hydrogenations of carboxamides using rhenium catalysts usually produced the amine, but undesirable side reactions occurred (H. S. Broadbent, G. C. Campbell, W. J. Bartley, and J. H. Johnson, *J. Org. Chem.* 24, 1847 (1959)). High temperature and pressure were required and N-dealkylation was a major reaction pathway in some cases. Scrambling of different N-alkyl groups was also a problem (M. Sekiya and K. Ito, *Chem. Pharm. Bull. (Japan)* 14, 996 (1966); M. Sekiya and M. Tomie, ibid. 15, 238 (1697)).

Birch reduction of carboxamides was a general technique only for secondary or tertiary carboxamides and produced the aldehyde, not the amine or alcohol (A. J. Birch and H. Smith, *Quart. Rev. (London)* 12, 17 (1958)).

Metal hydride reducing agents have produced a variety of products, sometimes resulting from dehydration of the primary carboxamide to give a nitrile (M. S. Newman and T. Fukunaga, *J. Amer. Chem. Soc.* 82, 693 (1960); S. E. Ellzey, C. H. Mack, and W. J. Connick, *J. Org. Chem.* 32, 846 (1967)). Occasionally, the acyl carbon-nitrogen bond was cleaved (N. G. Gaylord, "Reduction with Complex Metal Hydrides," Interscience Publishers, New York, 1956, pp. 544–594). Aldehydes were also produced when hydrides were used. Primary carboxamides reacted sluggishly and one equivalent of active hydride was consumed for each proton on nitrogen. These factors in addition to both the high cost of hydride reagents and their difficulty in handling made this methodology unsuitable for industrial processes. Furthermore, the strongly basic nature of hydrides initiated unwanted side reactions which were a further complicating factor.

With regard to the production of pyridyl carbinols, the carboxamide functionality was not used as a starting material except during electrolytic reduction. For instance, the pyridine carbonitriles were reduced catalytically used Pd on carbon catalyst and aqueous hydrochloride acid (U.S. Pat. No. 2,615,896). The pyridine carboxylic esters were also reduced to the carbinols using hydride reagents (British Pat. No. 631,078); and the pyridine carboxylic acids were reduced with zinc in acetic acid (F. Sorm and L. Sedivy, *Coll. Czech. Chem. Commun.* 13, 289 (1948)). Each of these reductions suffered from one or more of the following disadvantages: use of corrosive reagents, high temperatures, expensive reagents, or being applicable only in special restricted cases or circumstances.

Electrochemical procedures fulfill many of the desired features of an ideal carboxamide reduction since low temperatures can be used, the electron is an inexpensive reducing agent, the technology is generally applicable, selectivity can be achieved, and such methods normally do not place high demands on pollution controls. In the case of pyridine carboxamides, there have been some analytical studies, particularly of the three isomeric monocarboxamides (V. A. Serozetdinova, B. V. Suvorov, and O. A. Songina, *Khim. Geterotsikl. Soedin.* 1973, 327; D. Therenot and R. Buret, *J. Electroanal. Chem. Interfacial Electrochem.,* 40, 197 (1972); C. O. Schmakel, K. S. V. Santhanam and P. J. Elving, *J. Electrochem. Soc.* 121, 345 (1974)). However, these analytical procedures were unsuitable for producing more than milligram quantities of products and, in some cases, even the identity or quantity of products formed were unknown.

The need for selectivity is a key criteria in determining the utility of electrochemical technology since there are six possible major reduction products obtainable from a carboxamide reduction by five reaction pathways. Moreover, additional products can be formed from these initial six major ones either by chemical reaction, for instance, of the radical anion shown in pathway I, or by further reduction processes, for instance, of the aldehyde shown in pathway III. Graphically, these can be depicted as follows for three given radicals $R^1$, $R^2$ and $R^3$:

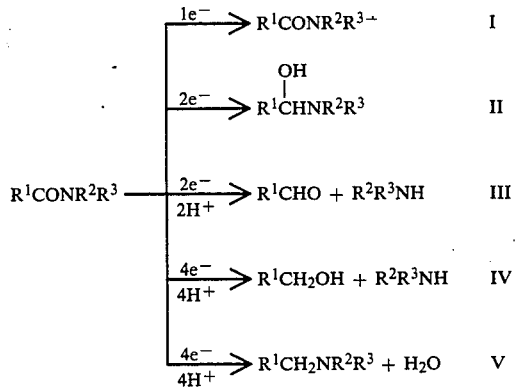

The reduction of carboxamides to amines (pathways III, IV, V) has been the most extensively studied of these reactions. The other two (I, II) are simply alternate pathways that the reaction can proceed through, the first (I) having shown only efficacy with nicotinamides while the second (II) involving products which are not usually stable on isolation.

Besides these five pathways, further reduction of the products, or alternative pathways altogether, have been reported for pyridine carboxamides. For example, the product alcohol or amine was reductively cleaved to the corresponding picoline; in addition, pyridine ring reduction took place at all stages to form a muiltitude of pyridine and reduced-pyridine products (F. Sorm., *Coll. Czech. Chem. Comm.*, 13, 57 (1948); J. P. Wibault and H. Boer, *Rec. Trav. Chim.*, 68, 72 (1949); M. Ferles and M. Pyrstas, *Coll. Czech. Chem. Commun.*, 24, 3326 (1959); M. Ferles and A. Tesarova, ibid., 32, 1631 (1967)). A study by Iversen reported in *Acta. Chem. Scand.* 24, 2459 (1970) explored the possible electrochemical reduction of picolinamide and isonicotinamide to the corresponding aldehydes. However, there was no attempt to investigate the utility of this reaction past the aldehyde stage. In addition, the Iversen reductions were done at a mercury cathode which is unsuitable for industrial use due to the toxic nature and strict environmental regulation of mercury. Aqueous hydrochloric acid was used as the electrolyte and due to the noxious and corrosive nature of HCl, this should be avoided for industrial utility. Still further, the aldehydes Iverson produced were shown to preferentially dimerize on further electrochemical reduction which significantly limits the selectivity of such processes to form carbinol products (pathway IV) which proceed through this aldehyde stage (J. F. Rusling and P. Zuman, *J. Org. Chem.*, 46, 1906 (1981)).

Three other reports of electrochemical reduction of pyridine carboxamides are known. The report by Nonaka, et al., *Electrochim. Acta.* 26, 887 (1981) described a technology that uses a mercury cathode which was not suitable for industrial use for the reasons mentioned above. Two reports by H. Lund (*Acta Chem. Scand.* 17, 2325 (1963) and *Abhandl. Deut. Akad. Wiss. Berlin Kl. Chem., Geol., Biol.* 1, 434 (1964)) explored the carboxamide reductions using a controlled junction potential at a mercury cathode and using aqueous hydrochloric acid electrolyte or acetic and citric acid buffers. Besides the same impracticality of these cathode and electrolyte materials. Lund's product distribution was pH dependent. In strong acid, below pH≈3.5, the major product of isonicotinamide reduction was reported to be the aldehyde (pathway III). If the reduction continued in strong acid past the aldehyde stage, the carbinol became the major product in a reported 53% yield. Up to 2 Faradays per mole of charge passed, however, the aldehyde was the sole product. In weak acid, above pH≈3.5, no aldehyde was apparently formed even at intermediate stages of the reduction and the major product was reported to be the carbinol (pathway IV). In contrast, the tertiary carboxamide, N-phenyl-N-methyl-isonicotinamide, gave no aldehyde on reduction even at low pH. The secondary carboxamide, N-phenylisonicotinamide, also gave no aldehyde even at low pH.

Thus, in Lund's work, the reported selectivity of product formation was not good, except in weak acid media which suppressed the amine formation. Even then the yield was not high. This work also required using a power supply (potentiostat) that controlled the cathode junction potential. This is impractical for commercial syntheses as such potentiostats are only useful in a laboratory environment. In contrast, power supplies which control the output current or output voltage are used in commercial applications, as are uncontrolled power supplies. However, the use of such a controlled-current power supply in place of the potentiostat resulted in worse product mixtures and reportedly reduced selectivity even further (H. Lund, *Adv. Heterocycl. Chem.* 12, 305 (1970)).

In addition to the points discussed above, all literature and patent references known to the applicant which have explored such electrochemical means at all have made use of rudimentary beaker cell technology which has little or no commercial significance. Although these beaker cells are acceptable for small-scale syntheses and analytical experiments, they have little economic value and are not preferred cell types for a commercial setting. There is no teaching or suggestion in any reference to applicant's knowledge that such electrochemical reductions of pyridine carboxamide bases have been or can be performed or even attempted, using other cell geometries and techniques which may have commercial importance.

SUMMARY OF THE INVENTION

Applicant's present invention corrects these deficiencies previously experienced in the art, and in so doing proves for the first time the viability of conducting electrochemical reductions of pyridine carboxamide bases in commercially practicable flow cells using a practical type of power supply. In so doing, applicant's reductions were done at planar and high-surface area cathodes, and without the necessity of highly-corrosive electrolytes, and were continued to successfully achieve large-scale selective syntheses of the corresponding alcohols or amines. Applicant's preferred flow cells are not restricted as to particular design geometries, with factors such as electrolyzer feed rate and preparation, production isolation, user need and the like governing the particular design and processing used.

In applicant's preferred electrochemical reduction of pyridine carboxamides and their substituted bases, as described and depicted in detail hereinbelow, all of these above advantages have been achieved in addition to obtaining improved yields at high current efficiencies. Lead and alloyed lead cathodes have been preferred, as has an aqueous or partly aqueous electrolyte which comprises a Lowry-Bronsted acid (i.e. a proton donor) in at least about a 1:1 equivalent ratio with the selected base, and preferably in a 1:1 mole ratio. Especially preferred are sulfuric or phosphoric acids and other noncorrosive strong acids. Applicants has also discovered that the presence of at least a catalytic amount of titanium, preferably as a salt, in the electrolyte greatly improves process selectively in yielding the corresponding amines by apparently inhibiting the formation of carbinol which otherwise would reduce the yield of amine and be troublesome in whatever isolation method is employed. In the absence of such titanium salts or their equivalents, the reduction gives high selectivity for carbinol formation with very little amine being formed. In addition, at intermediate stages of charge passage, applicant has found that no aldehyde has been detected which is also of importance in connection with possible isolation and recovery procedures.

Applicant has also discovered that the yield of carbinol can be enhanced by limiting the amount of carboxamide present in the electrolyte at any given time. This can be accomplished preferentially by addition of carboxamide to the catholyte, either in stages or continuously, throughout the reduction. Applicant's reductions have preferably been done at a high-surface area lead cathode in a filter-press flow cell, and have achieved many advantages in contrast to existing methods both in economy of processing and in technology associated with processing and product isolation, as further described hereinbelow.

Applicant's preferred reductions have also utilized a power supply wherein a parameter other than the electrode junction potential was controlled. For example, this was achieved by controlling either the current flowing through the cell or controlling the supply output voltage. In addition, an uncontrolled power supply was used.

Related objects and advantages of the present invention will be apparent from the following description.

DESCRIPTION OF THE PREFERRED EMBODIMENT

For the purposes of promoting an understanding of the principles of the invention, reference will now be made to the several embodiments herein and specific language will be used to describe the same. It will nevertheless be understood that no limitation of the scope of the invention is thereby intended, such alterations and further modifications and applications of the principles of the invention as described and claimed herein being contemplated as would normally occur to one skilled in the art to which the invention relates.

In accordance with the above summary, applicant has discovered and proven in one preferred embodiment of his present invention that electrochemical reductions of substituted or unsubstituted pyridine carboxamide bases are successfully performed in a flow cell having definite commercial and industrial applications. As also mentioned previously, this discovery has been an improvement and continuation of applicant's earlier work as described and claimed in U.S. Pat. No. 4,482,437 issued Nov. 13, 1984, which is hereby incorporated herein by reference in its entirety as to all pertinent and relevant aspects thereof.

As used in this application, the phrase "electrochemical reduction" is meant to include all possible variations as to reaction conditions and the like which are known or become known to those of ordinary skill in the art to which applicant's invention pertains. The only exceptions to this relate to any specific conditions or features which have shown to be required from applicant's testing to date which are further detailed hereinbelow. The phrase "flow cell" is meant to be restrictive only in the sense of excluding any cell consisting of a tank, beaker or container of similar function which is employed as a mixed or unmixed electrolyzer and which is limited by the inability to achieve a substantially plug flow of electrolyte in the reactor, by the inability to obtain a high space-time yield consistent with more sophisticated electrolyzers, or by the inability to effectively use ion-exchange membranes which are most often conveniently made and purchased in sheet form. In so doing, the phrase "flow cell" is meant to include all other electrolyzers which may employ either a batch or continuous mode of operation with a substantially plug flow of solution through the reactor and which can be conveniently constructed as filter-press, disc-stack, or concentric tube cells. For example, this includes both batch reactors where the electrolyte is continually recirculated through the closed loop as well as continuous processes where steady-state conditions are approached and/or product is continually removed and the electrolyte regenerated for further use. No cell geometries are excluded from the scope and intent of applicant's invention so long as they comply with these fluid-flow characteristics.

With regard to what bases are useful in applicant's invention, all pyridine carboxamides tested to date have been successfully reduced in applicant's electrochemical flow cell reaction to their corresponding alcohols or amines. Moreover, each base tested has proven susceptible of being selectively reduced to maximize formation of the desired product or products using various of the preferred aspects of applicant's invention as described more fully below. From these experiments, and from the information thereby gained and that already known about such bases and their characteristic behavior in reduction and other reactions, the conclusion has been reasonably drawn that all substituted or unsubstituted pyridine carboxamides will react similarly to effectively reduce their amide moiety to its appropriate alcohol or amine derivative. Although other ring constituents in substituted bases have participated and would participate in the reduction, either preceding, following or even simultaneously being reduced along with the amide, they have not prevented and would not prevent the amide itself from reducing when the reaction was continued and sufficient current passed.

With each particular pyridine carboxamide base used, the choice of reactor and operational mode for use with applicant's invention varies according to the particular chemistry involved, both as to reaction conditions which must be observed as well as other factors affecting product separation, purification, and the like. Applicant's preferred electrochemical flow cell to date is his own filter press cell which is the subject of U.S. patent application, Ser. No. 670,331 filed Nov. 9, 1984 and entitled Filter Press Electrochemical Cell with Improved Fluid Distribution System, now U.S. Pat. No. 4,589,968, which is a continuation of an earlier-filed application, Ser. No. 477,529 filed Mar. 21, 1983 now abandoned. Accordingly, this continuation application is hereby incorporated herein by reference in its entirety as to all pertinent and relevant aspects thereof relating to prior cell design technology and to the disclosure and understanding of applicant's preferred flow cell as used herein.

Applicant's preferred electro-reductions to date have used a high hydrogen-overvoltage cathode such as lead, cadmium or zinc and the like which can be alloyed with, and possibly supported on, such materials as antimony, silver, iron, titanium, copper, carbon and the like. As stated earlier, an aqueous or partly aqueous electrolyte has been preferred comprising a proton donor acid or Lowry-Bronsted acid in at least a 1:1 equivalent ratio with the pyridine carboxamide precursor to be reduced. Most preferred from tests thus far has been at least a 1:1 molar ratio between the acid and the carboxamide base. The base itself may either all be in solution or some amount may be undissolved and present as a slurry in the electrolyte bath, depending in part on the concentration and solubility limits of the base and the specific acid used. Regardless, all of the base present in the bath, or to be added to the bath, is considered in determining this ratio.

Applicant's preferred Lowry-Bronsted acids have been strong, noncorrosive acids including sulfuric and phosphoric, especially in at least a 1:1 mole ratio with the base. In this regard, sulfuric acid has been most preferred thus far although other strong protonic acids could be used. An amount of an organic solvent has also been successfully mixed with water in the medium in several experiments to date, although applicant's work has shown that at least a partly aqueous bath containing about 5 weight percent water or more should be maintained to effectively proceed with the reduction. Suitable solvents for this purpose include polar materials such as lower alcohols, ketones, and carboxylic acids or esters, or nonpolar materials such as toluene, cyclohexane, and hexane, or dipolar aprotic materials such as acetonitrile, dimethylformamide, and 1-formylpiperidine, or any other such material that would occur to one skilled in this area.

Applicant's preferred reductions have taken place in a filter-press flow cell equipped with an ion-exchange membrane divider, in contrast to the ceramic diaphragms or other porous, nonselective dividers which have been used in beaker cells in the past. These reductions have achieved many advantages in contrast to existing methods both in economy of processing and in technology associated with processing and product isolation, as are further described below.

Applicant's reductions have utilized a power supply wherein a parameter other than the electrode junction potential was controlled. For example, this has been preferrably accomplished thus far by controlling either the current flowing through the cell by the use of a galvanostat or by controlling the supply output voltage. Alternately, an uncontrolled power supply has also been successfully used. In this regard, power supplies suitable for use with applicant's invention are readily available on the market from numerous companies, such as H. B. S. Equipment Division located in Los Angeles, Calif.

Applicant has discovered in his preferred embodiments to date that the presence of at least a catalytic amount of titanium, most preferably as a titanium salt, in the medium or bath enhances the yield of amines from the reaction. This is believed to be accomplished at least in part by inhibiting the formation of unwanted products of the reaction such as the carbinol or the like. Still further, applicant has found that the carboxamide base is preferably added over time during the course of the reduction to also improve yield and suppress these unwanted byproducts of the reaction which have plagued the prior art processes described in the background section of this application. For example, applicant has discovered that the yield of carbinol can be enhanced by limiting the amount of carboxamide present in the electrolyte at any given time. This can be accomplished preferentially by addition of carboxamide to the catholyte, either in stages or continuously, throughout the reduction.

As to specific conditions of applicant's reactions to date, preferred temperatures have ranged between about 0°–110° C., with about 25°–70° C. being most preferred. Preferred current densities have ranged between about 0.1–200 mA/cm$^2$, with about 5–100 mA/cm$^2$ being most preferred. As to the electrolyte bath itself, instantaneous pyridine carboxamide concentrations have preferably been maintained between about 0.01–35 wt%, while most preferred has been a range of about 0.05–5 wt% in solution at any given time. Concentrations of the titanium salt catalyst in the medium have been as low as 1 ppm up to the solubility limit of the particular salt with enhanced results being obtained. Most preferred, however, has been the addition of titanium sulfate to a partly or wholely aqueous sulfuric acid-containing system so as to achieve an end concentration from about 500 ppm up to the solubility limit in solution.

In addition to those individual advantages mentioned above, general benefits have been found to exist with applicant's preferred flow cell arrangements and processes as described in this application. These features include such things as the ability to continually remove heat from the flow cell as, for example, by circulating the electrolyte through a heat exchanger or similar apparatus during the process. Continual product removal and regeneration of the electrolyte is also possible, as described above, using standard and accepted procedures known to those of ordinary skill in the art with regard to the particular reaction involved. Specific electro-reductions have also proven to be more efficient than prior art reports, and have the benefit of being able to use high-surface area (HSA) cathodes at which the reduction takes place. Examples of such HSA electrodes are wire meshes, metal particles such as lead spheres or other packing material, as well as those discussed in more detail in applicant's electrochemical cell application previously incorporated herein by reference.

Reference will now be made to specific examples for the purpose of further describing and understanding the features of applicant's preferred embodiments as well as their advantages and improvements over the art. In this regard, where possible, specific reference has been made in the examples to known prior art processes in order to better understand and distinguish applicant's invention herein. It is further understood that these examples are representative only, and that such additional embodiments and improvements of the same are within the contemplation and scope of applicant's invention as would occur to someone of ordinary skill in this art.

EXAMPLE 1

Reduction of Picolinamide

A flow cell having a cation-exchange membrane and a lead cathode consistent with that disclosed in U.S. Pat. No. 4,589,968 was used. A catholyte was prepared from the following weight parts: picolinamide (0.1), sulfuric acid (1.0), water (2.9). The anolyte was dilute sulfuric acid. Charge was passed through the cell and additional carboxamide continuously added (1.0 parts total) until greater than 95% conversion of the picolinamide was achieved. Analysis by HPLC indicated an 86% yield and 95% current efficiency had been obtained. Physical isolation of the carbinol product by neutralization with base followed by extraction and distillation gave an 81% yield. The spectral and physical properties of the isolated product, 2-pyridylcarbinol, matched those of an authentic sample. When the charge passed was restricted to approximately 2F/mole, no aldehyde was detectible by either analysis or isolation; a 78% yield of carbinol was realized based on carboxamide converted.

An identical reduction with added titanium salts gave a 70% yield of 2-picolylamine by similar analysis. Additional experiments were also conducted using other cathode materials such as mercury, lead amalgams or other lead alloys, copper, silver, cadmium and zinc, with varied success. Best results were obtained with the high hydrogen-overvoltage cathodes such as lead, mercury, lead amalgams, cadmium and zinc. Organic cosolvents and other strong acids were used in these additional experiments and were also found to be acceptable, but not necessarily beneficial.

EXAMPLE 2

Reduction of Niacinamide

The procedure in Example 1 was used except for substituting niacinamide for picolinamide. The isolated yield of 3-pyridylcarbinol was 65% at 70% current efficiency. When titanium salts were added, a 75% yield of 3-picolylamine was realized. If the total 1.0 parts of carboxamide were added to the catholyte before charge passage (no titanium salts added), then a 31% yield of carbinol was seen and very little 3-picolylamine could be detected. The dimer seen during aldehyde reduction was also absent.

EXAMPLE 3

Reduction of Isonicotinamide

The procedure in Example 1 was used except for substituting isonicotinamide for picolinamide. The yield of 4-pyridylcarbinol was 89% at 100% current efficiency. When titanium salts were present, the yield of 4-picolylamine was 72%. When the full charge of carboxamide was added initially (no titanium salts present), a 66% yield of carbinol was isolated.

EXAMPLE 4

Reduction of Dinicotinic Acid Diamide

The procedure of Example 1 was used by substituting the diamide for picolinamide to give a 59% yield of 3,5-pyridinedimethanol at 53% current efficiency.

EXAMPLE 5

Reduction of 2-Methylisonicotinamide

The procedure of Example 1 was used to prepare 2-methyl-4-pyridylcarbinol in 97% yield and 100% current efficiency.

EXAMPLE 6

Reduction of 5-Methylnicotinamide

The procedure in Example 1 was modified such that 2.0 weight parts of sulfuric acid was used instead of 1.0 parts and 5-methylnicotinamide was substituted for the picolinamide. The yield of 5-methyl-3-pyridylcarbinol was 69% at 78% current efficiency.

EXAMPLE 7

Reduction of N̄-Phenylisonicotinamide

The procedure of Example 7 was used by substituting isonicotinic anilide for the 5-methylnicotinamide. Analysis of the catholyte by HPLC showed a 61% yield of 4-pyridylcarbinol at 90% current efficiency and a 79% yield of aniline. Addition of titanium salt gave a 76% yield of N-phenyl-4-aminomethylpyridine.

EXAMPLE 8

Reduction of N',N'-Dimethylisonicotinamide

The procedure of Example 1 was used by substituting isonicotinic dimethylamide for the picolinamide to give an 86% yield of 4-pyridylcarbinol by gas-chromatographic analysis of the catholyte after neutralization with base.

EXAMPLE 9

Reduction of 4-Phenylpicolinamide

The procedure of Example 1 was used except that the catholyte was prepared from the following weight parts: 4-phenylpicolinamide (0.3), phosphoric acid (0.9), water (2.0), and toluene (0.8). The reduction was carried out similarly to Example 1 to give a 71% yield of 4-phenyl-2-pyridylcarbinol at 5.8 F/mole charge passage. Repeating the reduction with no toluene added gave a 49% yield of carbinol at 6 F/mole charge passage. Addition of a titanium salt to the catholyte containing added toluene resulted in a 55% yield of 4-phenyl-2-picolylamine by HPLC analysis. Other cathode materials than lead were also used successfully such as cadmium or zinc with similar results.

EXAMPLE 10

Reduction of 2-Aminoisonicotinamide

The procedure of Example 9 was used to prepare 2-amino-4-pyridylcarbinol in 93% yield by gas chromatographic analysis of the neutralized catholyte.

EXAMPLE 11

Reduction of 6-methoxypicolinamide

The procedure of Example 1 was used to prepare 6-methoxy-2-pyridylcarbinol in 81% yield and 86% current efficiency.

EXAMPLE 12

Reduction of 4-cyanopicolinamide

The procedure of Example 1 was used except that 10 F/mole charge was passed. Neutralization of the catholyte with $NH_3$ and extraction with methyl isobutyl carbinol gave 4-aminomethyl-2-pyridylcarbinol in 98% yield. Addition of 0.5 weight parts of titanium sulfate to the catholyte resulted in a 15% yield of the above pyridylcarbinol and a 68% yield of 2,4-bis aminomethylpyridine.

I claim:

1. In an electrochemical reduction of a pyridine carboxamide base, the improvement comprising the step of conducting the electro-reduction reaction at a high hydrogen-overvoltage cathode in a flow cell having an ion-exchange membrane divider, said conducting further being in an aqueous or partly aqueous medium comprising a Lowry-Bronsted acid in at least a 1:1 equivalent ratio with the base.

2. The electro-reduction reaction in claim 1 in which the improvement additionally comprises the step of adding the base to the medium in increments during said conducting to limit the amount of unreduced base present in the bath at any given time as the reduction progresses.

3. The electro-reduction reaction in claim 2 in which the improvement additionally comprises the step of maintaining the temperature of the bath between about 0°–110° C. and the current density between about 0.1–200 mA/cm$^2$ during said conducting.

4. The electro-reduction reaction in claim 1 in which the improvement additionally comprises the step of adding an amount of a titanium salt or its precursor to the medium sufficient to produce a concentration of titanium above about 1 ppm in the bath during said conducting.

5. The electro-reduction reaction in claim 4 in which said adding is of a titanium sulfate and the acid is sulfuric acid.

6. The electro-reduction reaction in claim 3 or 4 in which the base is picolinamide.

7. The electro-reduction reaction in claim 3 or 4 in which the base is nicotinamide.

8. The electro-reduction reaction in claim 3 or 4 in which the base is isonicotinamide.

9. The electro-reduction reaction in claim 1 in which the improvement additionally comprises the step of adding a titanium salt or its precursor to the medium during said conducting sufficient to decrease the reduction product ratio of carbinol to amine by at least about 0.2.

10. The electro-reduction in claim 9 in which said adding is of a titanium sulfate and the acid is sulfuric acid.

11. The electro-reduction in claim 2 in which the carbinol product contains less than 20% yield of each of the possible amine products.

12. The electro-reduction in claim 1 in which said conducting additionally comprises utilizing a power supply wherein a parameter other than the electrode junction potential is controlled.

13. The electro-reduction in claim 1 in which the improvement additionally comprises the step of continuing said conducting until substantial reduction of the carboxamide moiety of the base in the bath has occurred.

14. An electrochemical bath comprising a pyridine carboxamide base in an aqueous or partly aqueous medium comprising a Lowry-Bronsted acid in at least a 1:1 equivalent ratio with the base, and additionally comprising an amount of a titanium salt or its precursor sufficient to produce a concentration of titanium above about 1 ppm in the bath.

15. The electrochemical bath in claim 14 in which the medium is at least about 5 weight percent water.

* * * * *